United States Patent [19]

Schultz

[11] Patent Number: 4,555,848

[45] Date of Patent: Dec. 3, 1985

[54] DEFENSE WEAPON

[76] Inventor: Charles J. Schultz, 5860 Middle Fork Dr., Sparks Township, Washoe County, Nev. 89431

[21] Appl. No.: 440,082

[22] Filed: Jan. 17, 1983

[51] Int. Cl.[4] ..... B26B 27/00

[52] U.S. Cl. ..... 30/297; 172/370

[58] Field of Search ..... 30/297, 298, 164.5, 30/164.8; 172/370

[56] References Cited

U.S. PATENT DOCUMENTS

| | | | |
|---|---|---|---|
| 173,435 | 2/1876 | Ball | 30/297 |
| 391,738 | 10/1888 | Cross | 30/297 |
| 664,627 | 12/1900 | Eberlein | 30/297 |
| 1,138,076 | 5/1915 | Brigance | 172/370 |
| 2,779,262 | 1/1957 | Furr et al. | 30/297 X |
| 2,802,264 | 8/1957 | Smith | 30/297 |
| 4,490,911 | 1/1985 | Schultz | 30/297 |

FOREIGN PATENT DOCUMENTS

| | | | |
|---|---|---|---|
| 492849 | 4/1919 | France | 30/297 |
| 1261519 | 4/1961 | France | 172/370 |

*Primary Examiner*—Jimmy C. Peters

[57] ABSTRACT

A defense weapon, comprising a toe boot which fits over the toe of a wearer's shoe and held securely in place by straps, one on each side of the toe boot, which are carried to the rear of a person's shoe, there tightly fastened and held by a belt and buckle type fastening device.

To the front of the toe boot is attached a long steel bolt having a very sharp point, and having four sharp cutting blades, that are welded to the spike bolt, near the pointed end of the spike bolt; the blades are spaced at ninety degree intervals around the circumference of the bolt.

The four bladed spike bolt can be unscrewed and carried with, and then when the defense weapon is needed, in times of danger, the bladed spike bolt can be screwed into the toe boot adapter, and hand tightened, making the defense weapon ready for use.

1 Claim, 5 Drawing Figures

FIG. I
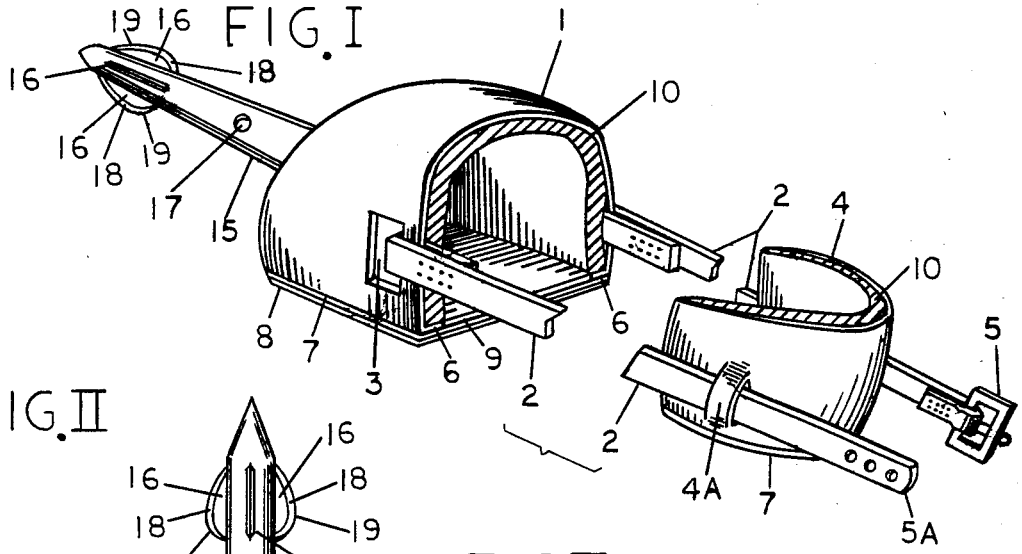
FIG. II
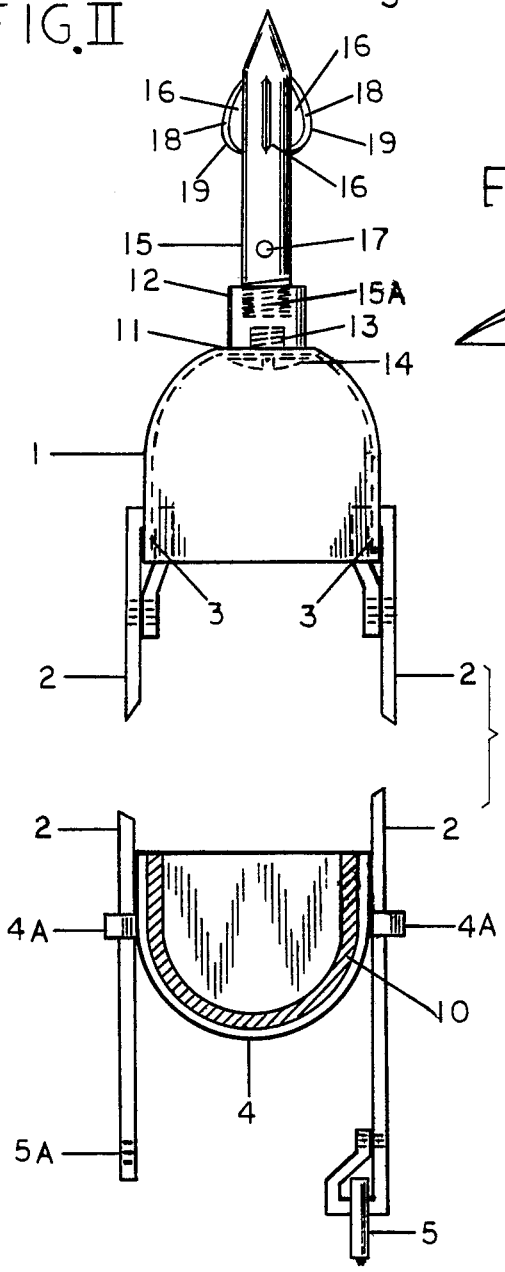
FIG. V
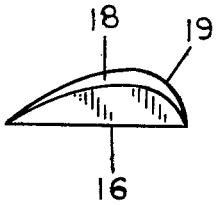
FIG. III
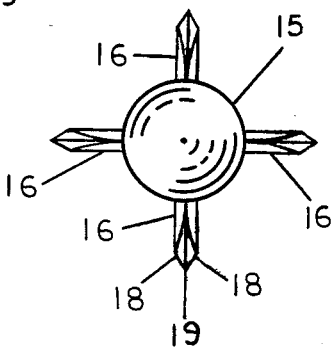
FIG. IV
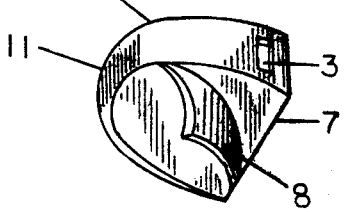

DEFENSE WEAPON

My invention relates to that class of weaponry which are called defense weapons, and is specifically designed for that purpose, with particular attention given to a defense weapon to be used in the home.

Of the defense weapons in use today, the major ones are the handgun, the shotgun, and the rifle. However, these same weapons can be immediately used, without conversion, as offensive weapons in the commission of vicious crimes, such as robbery, rape, and murder.

Also, statistics show that these named weapons can be dangerous in the home. Children playing with these guns and family members engaged in a quarrel, have become victims of these weapons.

Further, it is stated that considerable training is needed to become proficient in the use of these weapons and to know when these weapons can be used without said use constituting excessive force.

Accordingly, an object of my invention is to provide a weapon that is truly defensive; a weapon that cannot be efficiently used in the commission of crimes.

Another object of my invention is to provide a weapon that is formidable, that is, exciting to fear and dread, and deterring approach.

Further, another object of my invention is to provide a weapon which almost everyone can use, the young and the elderly, the slight, the weak and the frail, male and female, and without special training.

Still further, another object of my invention is to provide a weapon that causes an injury that approximates in seriousness, the wound made by a handgun or long gun.

Continuing, another object of my invention is to provide a weapon that can be easily disassembled so that it can be carried with a person, and in that condition, is not a weapon; but that can be quickly assembled for use in dangerous places, such a darkened parking lots.

Additionally, another object of my invention is to provide a defensive weapon that is economical in cost compared to most firearms, and one that is easily manufactured by commonly known methods, by those skilled in the arts.

These stated objects, along with other objects, will become fully apparent and shown to be accomplished upon reference to the following description and the drawing, which is a part of this specification.

In said stated drawing,

FIG. I is a perspective view of a Spike Boot Defense Weapon, embodying the features of my invention.

FIG. II is a plan view in elevation of FIG. I.

FIG. III is a front view of spike bolt, showing arrangement of blades around the bolt, and the shape of the blades.

FIG. IV is a view of the bottom of the toe boot, showing the sole plate and the conventional shoe sole, which covers the sole plate.

FIG. V is an enlarged view in side elevation, showing the blade shape.

Referring more particularly to the drawing through the use of reference characters placed thereon, number,1, is a toe boot which is placed over the toe of a user's shoe. The toe boot,1, is set onto the shoe and held securely in place, by straps,2, that are attached in slots,3, one on each side, and to the rear of toe boot,1, said straps are then drawn rearwardly and then securely and tightly fastened behind the shoe, by belt,4, and buckle,5, or any of the commonly known and suitable fastening devices.

The toe boot,1, is made of metal, preferably steel. The gauge of the toe boot metal is number ten, however the gauge is not held strictly to that weight, and it is stated that any slight variation in gauge within normal limits is acceptable.

Of the various methods of manufacturing, die cast, mold casted, it has been found that the most economical method of manufacturing the toe boot,1, is to have it constructed in two parts.

The top part, with flange,6, to be stamped, and the bottom part, or sole plate,7, to be welded to flange,6. The sole plate,7, is welded, to the outside bottom of the flange,6.

The accomplished purpose of the sole plate,7, is to make a solidly constructed toe boot,1. The sole plate,7, being made of steel, would cause noise and slipping when walking, while wearing the toe boot, therefore, a shoe sole,8, is attached to the bottom of the sole plate,7. The shoe sole,8, is made of leather or neoprene, or any of the conventional shoe sole materials, and is of conventional thickness, and is attached to the sole plate,7, by an adhesive glue that is waterproof and that when dry, remains soft and flexible, as opposed to hard and brittle. Inside the toe boot,1, is a glued in inner sole,9. The toe boot,1, is manufactured in general sizes, medium, large, and extra large.

Inside the toe boot,1, is a one piece, thick, durable, cushioning pad,10, approximately three eighths of an inch thick, that covers both sides, and inside upper part of the toe boot,1.

The purpose of the pad,10, is to protect the wearer's shoe, absorb energy when the weapon is used, and to act as a spacer, so that one toe boot,1, will fit either a left or right shoe, since the general shape of the toe boot,1, is full round, with a flattened area,11, said area approximately one inch in diameter, and lying across the very front of the toe boot,1.

The pad,10, can be made of any of the commonly known materials that can accomplish the purposes of the pad.

The toe boot,1, has a flattened front area,11, so that an adapter,12, will fit flushly against the toe boot,1. The adapter, 12, is cylindrical in shape, and is three quarters of an inch wide, and three quarters of an inch long.

The adapter,12, is attached to the toe boot,1, by a machine screw,13. The machine screw,13, is fully threaded, has a threaded length of five sixteenths of an inch, with approximately twenty threads to the inch, and a diameter of one quarter of an inch.

The head,14, of the machine screw,13, is slotted, and is oversized, approximately five eighths of an inch in diameter, in order to make the assembled parts more stable, as pressure equals force divided by the area; and also, the head of said machine screw, 13, is shallow, making a low profile inside the toe boot, 1, when the machine screw,13, is inserted through the toe boot,1, from inside the boot.

However, the head,14, of the machine screw,13, shall not be so shallow as to compromise the integrity of the strength of the machine screw, said machine screw being made of steel.

The machine screw,13, is inserted from inside the toe boot,1, through a hole in the center of the flattened front area,11, the said hole in the toe boot,1, is of such diameter as to just allow the passage of the machine screw,13.

On one end, the adapter,12, has a centrally drilled, internal screw thread, that is one quarter of an inch in diameter, and five sixteenths of an inch in depth, said depth equalling the length of the machine screw,13.

The adapter,12, is screwed onto the machine screw,13, and tightened securely. There will then be a slight internal space between the end of the machine screw,13, and the end or bottom of the thread of the adapter,12, this space approximates the thickness or gauge of the metal toe boot,1, thus assuring a solid mechanical connection, following which the milled head of the machine screw,13, is spot welded inside the toe boot,1, and the adapter,12, is smoothly welded to the outside of the toe boot,1. The forward most part of the adapter,12, has a centrally drilled internal screw thread of one half inch diameter, and a threaded depth of approximately three eighths of an inch. Into this threaded end of adapter,12, is screwed a forwardly projecting, steel spike bolt, of one half inch diameter, and having four cutting blades. The male threaded end,-15A, of the bladed spike bolt, which screws into the adapter,12, has a threaded length of one half inch. The threaded parts have a close tolerance, so that there will be negligible wobbling, or movement to and fro, of attached parts. The total length of the four bladed spike bolt,15, is substantial, being approximately four and five eighths inches long, is cylindrical in shape, and is made of tool steel In constructing the spike of the bolt, approximately five eighths of an inch from the foremost end of the bolt, the bolt is machined down, without shortening the length of the bolt, to the very longitudinal axis of the bolt, thus creating a most extremely sharp point, which is the point of the bladed spike bolt,15.

Approximately one inch in front of the adapter,12, a hole,17, approximately one eighth of an inch in diameter, is drilled transversely through the spike bolt,15, which thereby allows for the tightening and/or loosening of the bladed spike bolt, by the use of a nail, awl or suitable instrument.

However, the bladed spike bolt,15, can be tightened or loosened by hand, which is one of the objects of my invention, thus allowing toe boots to be worn without bladed spikes, but enabling this defense weapon to be quickly and easily assembled if the wearer enters a dangerous area, such as a darkened parking lot, or if their automobile breaks down, requiring the driver to leave the vehicle, or if at home, the individual becomes a victim of an unwanted approach.

FIG. III shows four cutting blades,16, attached to the spike bolt,15, said cutting blades are identical, one to each other, are welded to the spike bolt, are made of stainless steel, and have outwardly disposed areas, that are approximately one eighth of an inch wide, are concavo-concave in shape, which said concavo-concave shape,18, terminates at the cutting edge,19.

The placement of the cutting blades,16, quarter the spike bolt, 15, longitudinally, that is, the blades are placed at ninety degree intervals around the circumference of the bolt, in a more or less north, south, east west, position.

The cutting blades,16, are welded to the spike bolt,15, approximately one eighth of an inch before the shape of the bolt begins to turn down towards the point of the bolt, as can be seen in FIG. II. Each cutting blade,16, is of conventional knife blade thickness, and at its base, which is the place of its weld to the spike bolt,15, the blade is one inch long.

FIG. V, shows a side view of a cutting blade,16. The front of the cutting blade is that part nearest the point of the spike bolt,15, as shown in FIG. II. Starting then at the front of the cutting blade,16, the cutting edge, 19, inclines upwardly from the horizontal base of the blade,16, at an angle of approximately thirty degrees and continues at that angle until a point is reached that is perpendicular to five eighths of the length of the base of the blade, measuring that length from the front of said blade.

The cutting edge,19, of the cutting blade,16, then levels off which is the widest part, said width being three eighths of an inch, following which, the said cutting edge curves downwardly in a rounded manner, at an angle of approximately fifty five degrees, ending at the rear base of the cutting blade,16.

The shape and design of each blade and the arrangement of the four blades on the spike bolt have been deliberately and precisely calculated for specific reasons.

Firstly, the shape of each cutting blade,16, being narrow at the front, allows for cutting to begin with little resistance, when this invention is used. After a blow is struck with this weapon, the cut made by the blade,16, widens as the blade widens.

When the bladed spike bolt,15, is withdrawn, it is easily pulled back, and does not catch, because the blades are not barbed at the rear, but are rounded, and also sharp, with cutting edge,19, allowing for additional cutting when the bladed spike bolt,15, is pulled back.

The four blades are arranged around the spike bolt at ninety degree intervals, so that when a blow is struck with this weapon, the blades cut in four different directions. The caliber of the spike bolt is larger than the caliber of most handguns and long guns, and can almost blow a hole in an assailant, but should the spike bolt miss vital internal areas of an attacker, the four cutting blades, which increase the diameter or caliber of the weapon, can cut through the body wall, lacerating arteries, veins, nerves, organs, and damaging bones.

The design of the bladed spike bolt,15, makes a wound that is one of the most difficult wounds to surgically repair, thus with, for example, a wound deep in the abdomen or the kidney region; after the bladed spike bolt. 15, is withdrawn, possibly continuing to make cuts at different angles, blood loss would have to be stopped at many places, with time being a major factor.

A wound of this seriousness, therefore, could almost not be repaired by home methods, therefore, an injured attacker would need immediately, medical attention.

This type wound approximates, in seriousness, that made by many firearms, and in many instances, is more shocking and devastating to the human system than small caliber firearms.

Every weapon leaves an identifying mark or pattern. The bladed spike bolt leaves a definite design, therefore, medical personnel treating this type of injury, would most likely consider the injured person an aggressor and with that, notify the proper authorities.

If the blow of the bladed spike bolt is a glancing one, a single blade can make a serious injury, by lacerating one or more blood vessels.

MODE OF OPERATION

There are many, many, methods and items in use today for individual protection. Besides handguns and long guns, used for self defense, there are, also in use, clubs, knives, throwing objects, sprays, and a general classification called, the martial arts, in which a person's arms and legs are used.

Almost all of these weapons of self defense require training, skill, and some extra physical strength.

My invention requires no training, no practice, no skill, and no extra strength, but rather utilizes one of the most basic human moves, that of kicking.

With bladed spike bolts attached to a person's shoes, an attack by an aggressor can be warded off by kicking, from the knee and/or hip, forwardly and upwardly, or also, from the side. Punches and blows by arms and hands can be blocked, parried, or slipped, but kicks are very difficult to block, therefore, the best way to avoid a kick is to move away, which is what a defender wants, and which said move accomplishes an object of my invention, that being to deter approach.

If a person is knocked to the ground, this weapon can still be effectively used, since it is possible to kick from the stated position.

As previously stated, my invention can be effectively used by the young and the elderly, the slight, the strong and the weak, the frail, male or female, and without special training.

From the foregoing, it is thought that the construction, operation, and many advantages of the herein described invention, without further description, will be apparent to those skilled in the art, and it will be readily apparent that changes in the size, shape, and minor details may be resorted to without departing from the spirit of the invention.

Having thus described my invention, what I claim as new, and desire to secure by Letters Patent is:

1. A defense weapon for an individual's protection against criminal attack, which said defense weapon comprises a toe boot that fits over and onto the front of the user's shoe, said toe boot having a long, substantially strong, forwardly extending bolt, with the forwardmost end of the bolt being brought to an exceedingly sharp point, said bolt then having attached around its circumference, a plurality of cutting blades, said bladed spike bolt then securely attached, by the use of an adapter, to the front of the toe boot, said toe boot, also having an interior, cushioning pad which protects the wearer's shoe, absorbs energy, and which also acts as a spacer, allowing a toe boot to fit either a left or right shoe, said toe boot also having a shoe sole attached to its exterior bottom, the bladed spike bolt, toe boot assembly then placed over and securely fastened onto the front of the wearer's shoe by the use of a strap and buckling device.

* * * * *